US010759068B2

(12) United States Patent
Lin

(10) Patent No.: US 10,759,068 B2
(45) Date of Patent: Sep. 1, 2020

(54) SCISSORS AND PLIERS COMBINATION TOOL

(71) Applicant: BINOVO MANUFACTURING CO., LTD, Yangjiang, Guangdong (CN)

(72) Inventor: Jieqing Lin, Guangdong (CN)

(73) Assignee: BINOVO MANUFACTURING CO., LTD, Yangjiang, Guangdong (CN)

( * ) Notice: Subject to any disclaimer, the term of this patent is extended or adjusted under 35 U.S.C. 154(b) by 1079 days.

(21) Appl. No.: 14/846,113

(22) Filed: Sep. 4, 2015

(65) Prior Publication Data

US 2015/0375405 A1 Dec. 31, 2015

Related U.S. Application Data

(63) Continuation of application No. PCT/CN2014/072982, filed on Mar. 6, 2014.

(30) Foreign Application Priority Data

Mar. 7, 2013 (CN) ..... 2013 2 0105600 U

(51) Int. Cl.
*B26B 11/00* (2006.01)
*B25F 1/00* (2006.01)
*B25B 7/22* (2006.01)

(52) U.S. Cl.
CPC ..... *B26B 11/001* (2013.01); *B25B 7/22* (2013.01); *B25F 1/003* (2013.01); *B26B 11/00* (2013.01); *B26B 11/003* (2013.01); *B26B 11/005* (2013.01)

(58) Field of Classification Search
CPC ... B26B 11/001; B26B 11/003; B26B 11/005; B25B 7/22; B25F 1/003
USPC ..... 7/118, 128, 135; 81/311
See application file for complete search history.

(56) References Cited

U.S. PATENT DOCUMENTS 803,512 A * 10/1905 Scott, Jr. ..... B25B 7/22 294/3
1,511,340 A * 10/1924 Jackson ..... B25F 1/003 7/131
5,142,721 A 9/1992 Sessions et al.
5,245,721 A * 9/1993 Lowe ..... B25F 1/003 7/107
5,743,582 A * 4/1998 Rivera ..... B25F 1/003 294/99.2
6,014,787 A * 1/2000 Rivera ..... B25F 1/003 30/152

(Continued)

FOREIGN PATENT DOCUMENTS

CN 2562925 7/2003
CN 203210339 9/2013
DE 29910934 8/1999

*Primary Examiner* — Brian D Keller
(74) *Attorney, Agent, or Firm* — Muncy, Geissler, Olds & Lowe, P.C.

(57) ABSTRACT

Disclosed is a scissors and pliers combination tool having a small thickness and facilitating operations. The combination tool comprises: scissors, pliers, a primary housing, a scissors handle, and a pliers handle, wherein the scissors and pliers have a folded state and unfolded state on the primary housing, and a folding or unfolding direction of the scissors is reverse to that of the pliers. In the unfolded state, the scissors handle and the primary housing form an operation handle of the scissors, and the pliers handle and the primary housing form an operation handle of the pliers.

17 Claims, 15 Drawing Sheets

(56) References Cited

U.S. PATENT DOCUMENTS

| | | | | |
|---|---|---|---|---|
| 6,216,301 | B1 | 4/2001 | Rivera | |
| 6,389,625 | B1 * | 5/2002 | Rivera | B25F 1/003 7/128 |
| 2002/0023302 | A1 * | 2/2002 | Montague | B23D 29/002 7/128 |
| 2009/0000038 | A1 * | 1/2009 | Padden | B25F 1/003 7/128 |
| 2010/0050827 | A1 * | 3/2010 | Lin | B25F 1/04 81/427.5 |
| 2012/0151681 | A1 | 6/2012 | Purnomohadi et al. | |
| 2017/0001295 | A1 * | 1/2017 | Sun | B25B 7/00 |

* cited by examiner

SCISSORS AND PLIERS COMBINATION TOOL

CROSS REFERENCE TO RELATED APPLICATIONS

This application is a Continuation of Application No. PCT/CN2014/072982, filed on Mar. 6, 2014, for which priority is claimed under 35 U.S.C. § 120; and this application claims priority of Application No. 201320105600.5 filed in China on Mar. 7, 2013 under 35 U.S.C. § 119, the entire contents of all of which are hereby incorporated by reference.

TECHNICAL FIELD

The present invention relates to the field of multifunctional foldable tools, and in particular, relates to a small-sized and compact scissors and pliers combination tool.

BACKGROUND

A small-sized combination tool is very welcomed by consumers with its small volume, easy carrying, and diversified functions. Specially, persons working in the wild field can obtain a multifunctional combination tool with no excessive loads thereon.

A traditional combination tool typically employs a parallel combination. Specifically, a large-sized tool head is independently folded in a housing having a U-shaped groove, multiple small-sized tool heads may be folded in the same housing which is subsequently parallelly spliced together the housing accommodating the large-sized tool head, thereby forming a multifunctional combination tool. However, with higher requirements being imposed on the function of the folding tool, it is generally required that at least two large-sized tool heads should be provided, which most commonly comprises scissors and pliers. In the prior art, generally scissors are independently folded in a housing, and pliers are independently folded in a housing, and then two housings are parallelly spliced. In this way, although the requirements on the functionality are met, the combination tool at least requires two parallelly spliced housings. In addition, both the scissors and the pliers are provided with two hinged parts which require a housing with a larger thickness to accommodate the structure thereof. As a result, the thickness of the combination tool is increased. Based on the above, it is obviously unsuitable to add other tools. Especially, for users whose palms are not sufficiently large, a thicker housing is very inconvenient to operate, which greatly restricts the extension of functionality of the combination tool.

SUMMARY

The technical problem to be solved in the present invention is to overcome defects in the prior art, and provides scissors and pliers combination tool which are easy to operate, and have thinner thickness in the whole. This tool is favorable to expand the function to a further extend.

Based on the above objective, the present invention is implemented by using the following technical solution.

The present invention discloses scissors and pliers combination tool comprising:

scissors having a front end and a rear end, and comprising a first scissors blade and a second scissors blade that are hinged through a first axle at a central portion;

pliers having a front end and a rear end, and comprising a first gripping jaw and a second gripping jaw that are hinged through a second axle at a central portion;

a primary housing having a first end portion and a second end portion, a first U-shaped groove being formed at the first end portion and a second U-shaped groove being formed at the second portion, wherein an opening direction of the first U-shaped groove is reverse to that of the second U-shaped groove, the rear end of the first scissors blade is hinged through a third axle to the first end portion, and the rear end of the first gripping jaw is hinged through a fourth axle to the second end portion;

a scissors handle, a front end of the scissors handle being hinged to the rear end of the second scissors blade through a fifth axle, and a third U-shaped groove being disposed on a side facing towards the scissors;

a pliers handle, a front end of the pliers handle being hinged to the rear end of the second gripping jaw through a sixth axle, and a fourth U-shaped groove being disposed on a side facing towards the gripping jaw;

wherein the scissors and pliers have a folded state and unfolded state on the primary housing, and a folding or unfolding direction of the scissors is reverse to that of the pliers;

from the unfolded state to the folded state, the scissors rotate around the third axle towards the primary housing and the scissors handle rotates around the fifth axle towards the primary housing, such that the scissors are folded in a space formed by the first U-shaped groove and the third U-shaped groove; pliers rotate around the fourth axle towards the primary housing and pliers handle rotates around the sixth axle towards the primary housing, such that the pliers are folded in a space formed by the second U-shaped groove and the fourth U-shaped groove; and from the folded state to the unfolded state, the scissors handle rotates around the fifth axle far away from the primary housing and the scissors rotate around the third axle far away from the primary housing, such that the scissors handle and the primary housing form an operation handle of the scissors; or the pliers handle rotates around the sixth axle far away from the primary housing and the pliers rotate around the fourth axle far away from the primary housing, such that the pliers handle and the primary housing form an operation handle of the pliers.

According to the present invention, a set of scissors and pliers may be folded on a primary housing provided that the width of the primary housing is slightly increased. The thickness of the scissors is typically much smaller than that of the pliers, and therefore the entire thickness of the primary housing is mainly determined by the thickness of the pliers. The folded structure employs the appearance characteristics of the scissors and pliers. Both the scissors blades and the gripping jaws have an outer profile having a slant face, which may be staggered in the primary housing after the scissors and the pliers are folded relative to each other. Therefore, two large-sized tool heads may be folded in the same housing. However, the thickness of the housing would not be increased, which is convenient for carrying and operation.

A first cantilever shrapnel is formed on a side bottom plate of the first U-shaped groove facing towards the scissors, a third cantilever shrapnel is formed on a side bottom plate of the third U-shaped groove facing towards the scissors, and rear ends of the first scissors blade and the second scissors blade have arc-shaped faces, a first step and a third step that mate with the first cantilever shrapnel and the third cantilever shrapnel in the unfolded state being formed on inner sides of the rear ends, and a first protrusion and a third protrusion that mate with the first cantilever shrapnel and the third cantilever shrapnel in the folded state being formed on outer sides of the rear ends. A second cantilever shrapnel is formed on a side bottom plate of the second U-shaped groove facing towards the pliers, a fourth cantilever shrapnel is formed on a side bottom plate of the fourth U-shaped groove facing towards the pliers, and rear ends of the first gripping jaw and the second gripping jaw have arc-shaped faces, a second step and a fourth step that mate with the second cantilever shrapnel and the fourth cantilever shrapnel in the unfolded state being formed on inner sides of the rear ends, and a second protrusion and a fourth protrusion that mate with the second cantilever shrapnel and the fourth cantilever shrapnel in the folded state being formed on outer sides of the rear ends. The cantilever shrapnel is to abut against the step on an inner side of the scissors blade or the gripping jaw when the scissors or the pliers are unfolded and used, which facilitates operations of the scissors or the pliers. The cantilever shrapnel is also to abut against a protrusion on an outer side of the scissors blade or the gripping jaw when the scissors or the pliers are folded for accommodation, which prevents looseness of the scissors handle or the pliers handle.

After the primary housing accommodates the scissors and the pliers, generally no extra space can be used to accommodate other tools. Therefore, according to the present invention, the rear end of the scissors handle or the rear end of the pliers handle is provided with a rotating tool, or the rear end of the scissors handle and the rear end of the pliers handle are each provided with a rotating tool. Disposing the rotating tool at each of these two positions is advantageous in that when the pliers handle or the scissors handle is opened to be perpendicular to the primary housing, the primary housing may serve as a handle of the rotating tool, thereby achieving a leverage effect and facilitating operations of the rotating tool. The rotating tool comprises: a slotted screwdriver, a cross screwdriver, a drill, and a corkscrew, or a combination of any two of them.

According to the present invention, the rotating tool is mounted in the third U-shaped groove, or the fourth U-shaped groove, or in the third U-shaped groove and the fourth U-shaped groove, a tool head is protrusively formed at a front end of the rotating tool, and an end face mating with the scissors or the tool head in the folded state is formed at a rear end of the rotating tool. In this way, after the combination tool is folded, the rotating tool achieves a function of closing the front ends of the scissors and pliers. In this way, under collaboration of the scissors handle and the pliers handle, a side face opening of the primary housing may be closed, thereby protecting the inner structure of the combination tool.

For ease of operation, an annular groove is disposed between two opposite faces of the first scissors blade and the second scissors blade, an annular spring being mounted in the annular groove, the annular spring having a preset resilience to support the first scissors blade and the second scissors blade in an open state when the scissors are in an unfolded state. In this way, during use of the scissors, by pressing the scissors handle, the blades of the scissors are closed for cutting; by releasing the scissors handle, under action of the annular spring, the first scissors blade and the second scissors blade restore to an opening state, thereby facilitating a next cutting operation.

For an extension of functionality of the combination tool, if a large-sized tool is to be added, the scissors and pliers combination tool needs to further comprise a secondary housing disposed on a side face of the primary housing, wherein the secondary housing forms a fifth U-shaped groove, a blade being foldably mounted in the fifth U-shaped groove. Since the blade has a smaller thickness, adding the secondary housing would not significantly increase the overall thickness of the combination tool. In a preferred embodiment, an inner side face of the secondary housing is provided with a locking shrapnel, wherein the locking shrapnel abuts against a side face of the blade when the blade is folded into the fifth U-shaped groove, thereby preventing the blade from being sliding out when not being used.

After a secondary housing is added, to fully utilize the additional space, the combination tool according to the present invention further comprises a secondary handle disposed on a side of the pliers handle or the scissors handle facing towards the secondary housing, and having a thickness the same as that of the secondary housing, wherein the secondary handle abuts against a side back to an opening of the fifth U-shaped groove of the secondary housing after being folded, and the secondary handle forms a sixth U-shaped groove, an opening direction of the sixth U-shaped groove being reverse to an opening direction of the fifth U-shaped groove, and a secondary tool head, such as a saw or a file, being internally foldably mounted in the sixth U-shaped groove. In the folded state, the secondary handle just mates with the secondary housing, thereby fully utilizing the additional space created by increasing the thickness due to adding the secondary housing.

According to the present invention, the scissors and the pliers are reasonably folded in the primary housing, and without increasing the thickness of the primary housing, the same housing is capable of accommodating two large-sized tool heads. The primary housing may serve as an operation handle of the combination tool. The handle having a small thickness is convenient for operations, especially for users whose palms are not sufficiently large. In addition, since the thickness of the combination tool is controlled, the combination tool may be subject to functionality extension. Even with extension of functionality, the thickness of the combination tool would not be greatly increased, and thus the tool is also convenient to operate.

DETAILED DESCRIPTION

Figure 1:
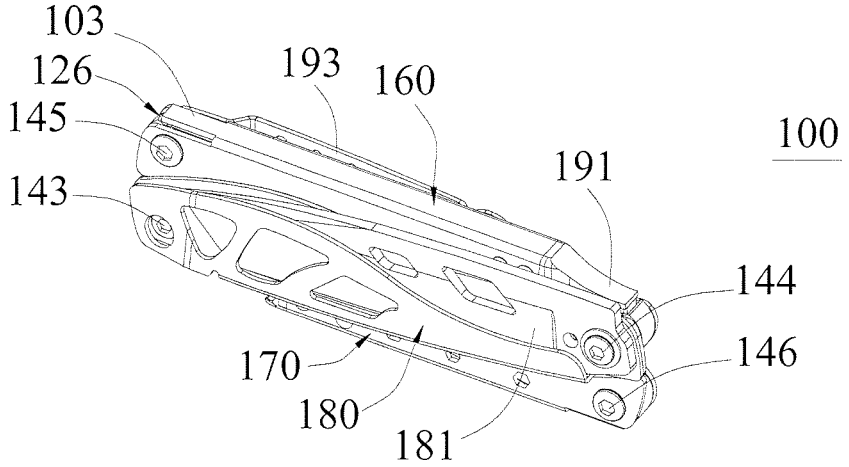
FIG. 1 is a schematic structural view of a scissors and pliers combination tool in a folded state according to Embodiment 1 of the present invention.

The present invention is further described with reference to specific embodiments and attached drawings. The drawings are for illustration purpose only, but shall not be construed as limitations to the present invention. For better illustration of the following embodiments, some parts or components would be omitted, scaled up or scaled down in the drawings, which are not indicative of the practical sizes. For a person skilled in the art, it shall be understandable that some commonly known structures and description thereof are omitted for brevity.

Embodiment 1

Figure 13:
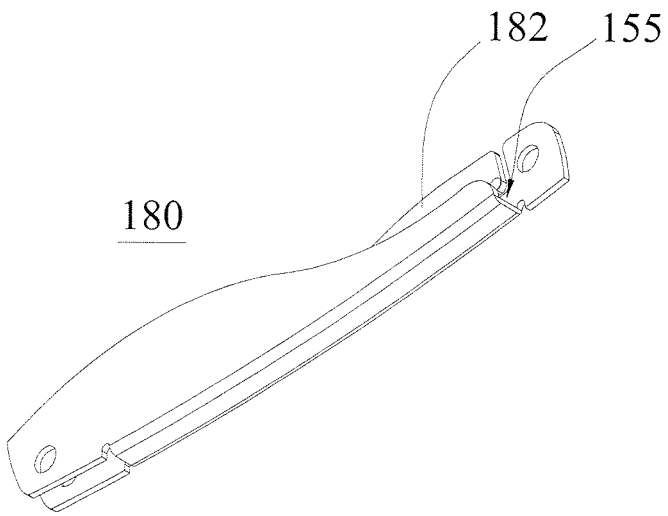
FIG. 13 is a schematic structural view of a secondary housing according to Embodiment 1 of the present invention.

With reference to FIG. 1, FIG. 2, FIG. 3, FIG. 4, FIG. 5, and FIG. 7, a scissors and pliers combination tool 100 comprises: scissors 120 having a front end and a rear end, and comprising a first scissors blade 121 and a second scissors blade 122 that are hinged through a first axle 141 at a central portion; pliers 130 having a front end and a rear end, and comprising a first gripping jaw 131 and a second gripping jaw 132 that are hinged through a second axle 142 at a central portion; a primary housing 110 having a first end portion 111 and a second end portion 112, a first U-shaped groove 151 being formed at the first end portion 111 and a second U-shaped groove 152 being formed at the second portion 112, wherein an opening direction of the first U-shaped groove 151 is reverse to that of the second U-shaped groove 152, the rear end of the first scissors blade 121 is hinged through a third axle 143 to the first end portion 111, and the rear end of the first gripping jaw 131 is hinged through a fourth axle 144 to the second end portion 112; a scissors handle 160, a front end of the scissors handle 160 being hinged to the rear end of the second scissors blade 122 through a fifth axle 145, and a third U-shaped groove 153 being disposed on a side facing towards the scissors 120; and a pliers handle 170, a front end of the pliers handle 170 being hinged to the rear end of the second gripping jaw 132 through a sixth axle 146, and a fourth U-shaped groove 154 being disposed on a side facing towards the gripping jaw 130. The scissors and pliers combination tool 100 further comprises a secondary housing 180, wherein a shape of the secondary housing 180 is as illustrated in FIG. 13, and the secondary housing 180 is disposed on a side face of the primary housing 110, and is connected to the side face of the primary housing 110 via the third axle 143 and the fourth axle 144. The secondary housing 180 forms a fifth U-shaped groove 155, wherein a blade 181 is foldably mounted in the fifth U-shaped groove 155, the blade 181 being rotatably connected via the fourth axle 144. An inner side face of the secondary housing 180 is provided with a locking shrapnel 182, the locking shrapnel 182 abutting against a side face of the blade 181 when the blade 181 is folded into the fifth U-shaped groove 155. A belt clamp 193 is further disposed on the other side of the primary housing 110 relative to the secondary housing 180.

Figure 2:
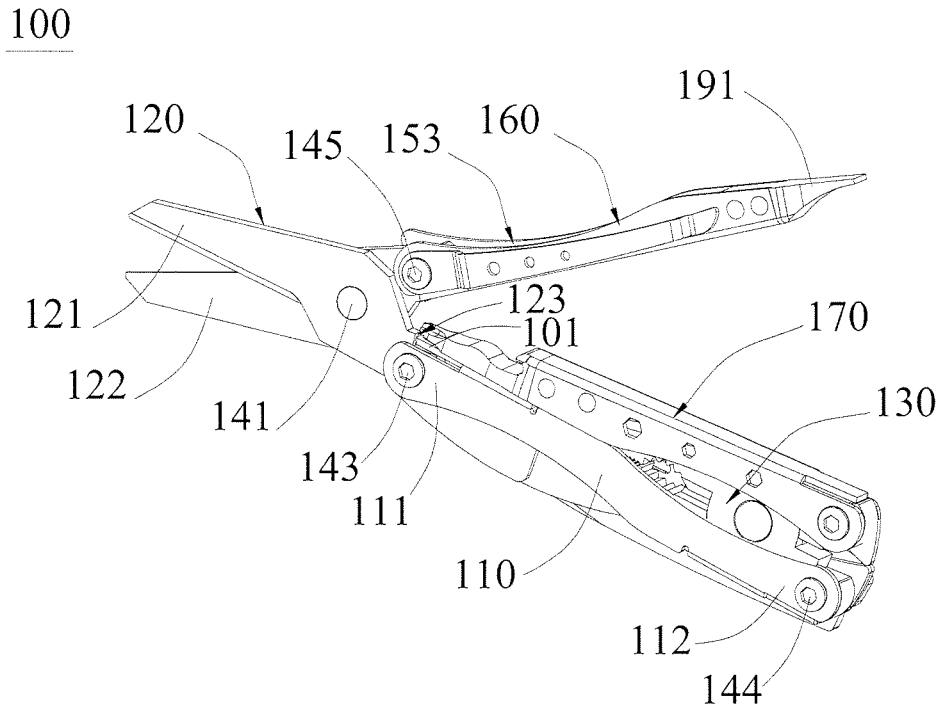
FIG. 2 is a schematic structural view of scissors in an unfolded state according to Embodiment 1 of the present invention.
Figure 3:
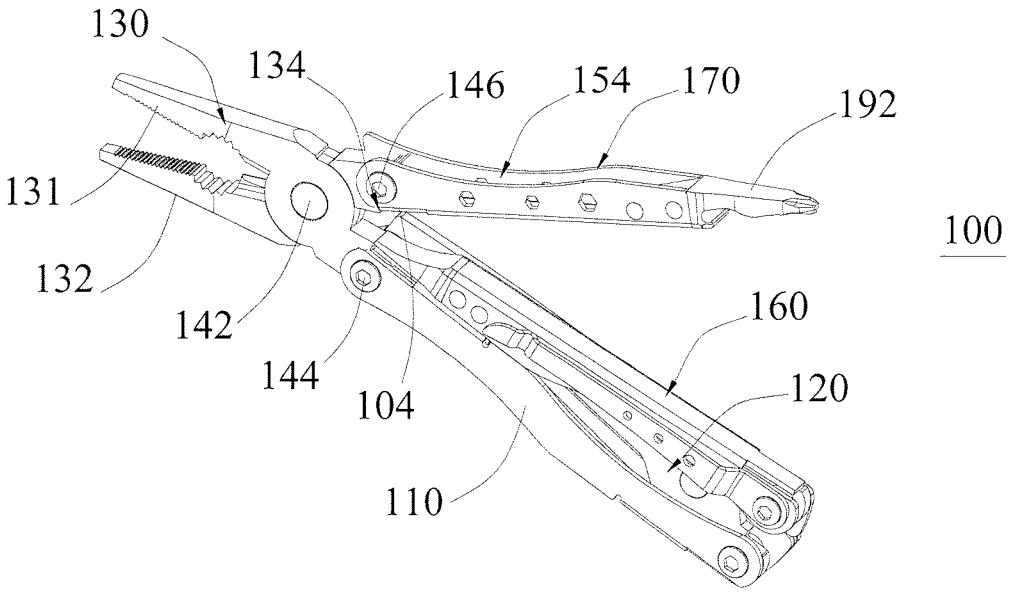
FIG. 3 is a schematic structural view of pliers in an unfolded state according to Embodiment 1 of the present invention.
Figure 4:
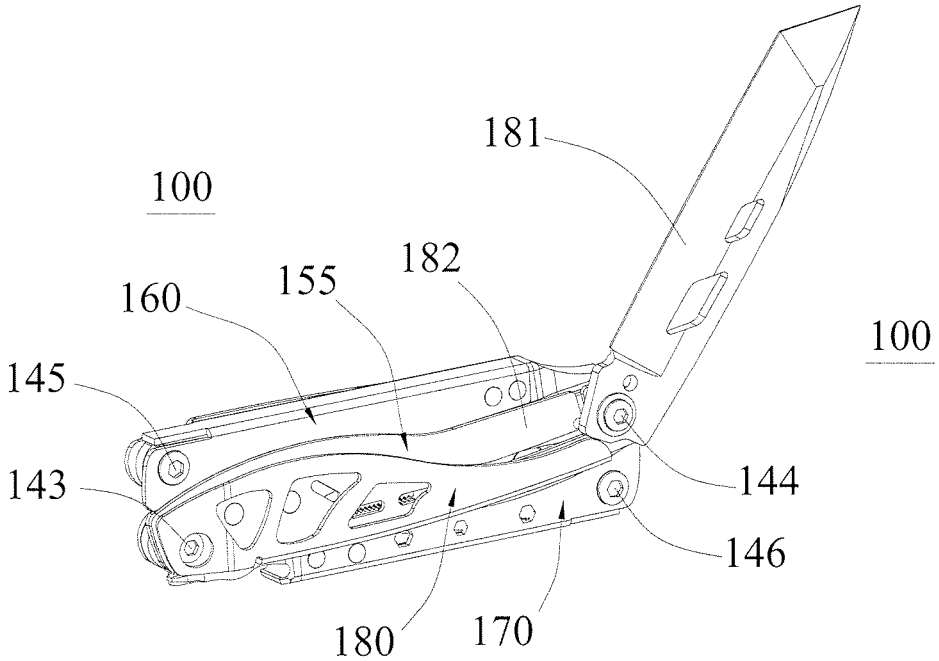
FIG. 4 is a schematic structural view of a knife in an unfolded state according to Embodiment 1 of the present invention.
Figure 5:
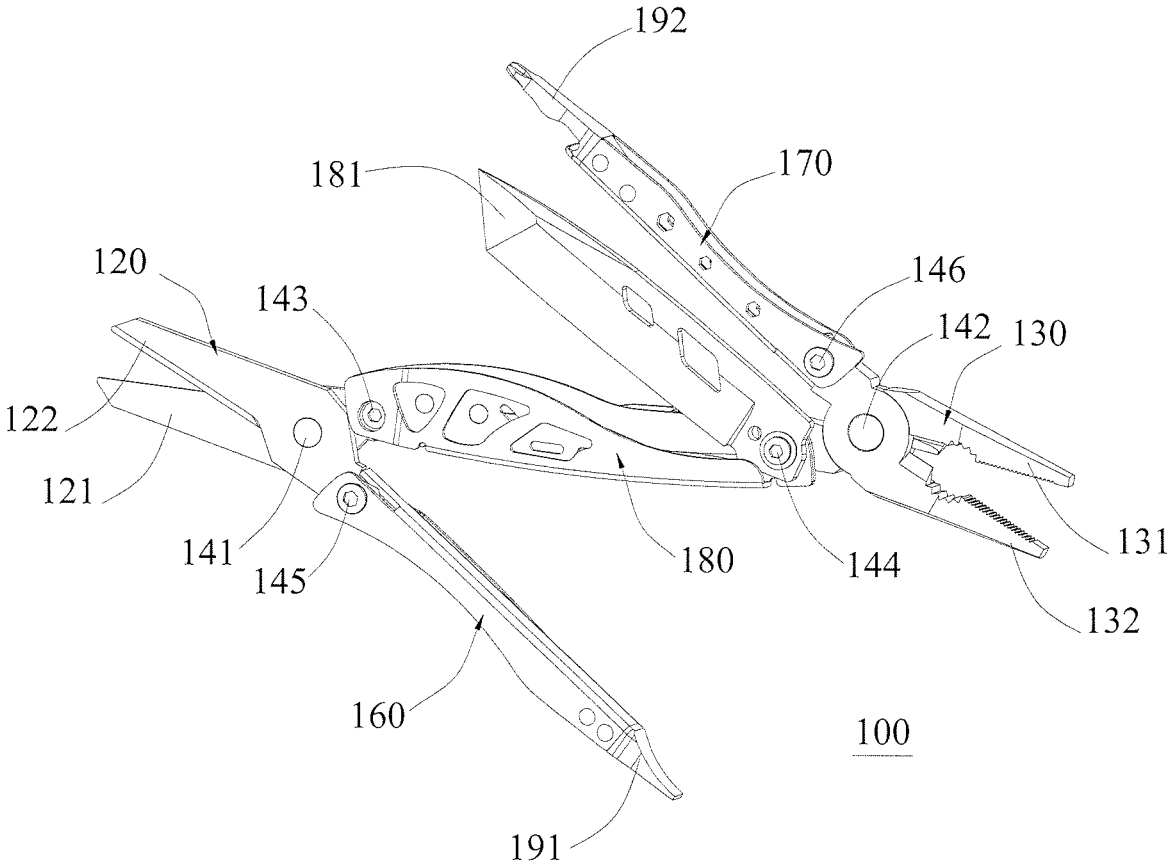
FIG. 5 is a schematic structural view of all tools in an unfolded state according to Embodiment 1 of the present invention.
Figure 14:
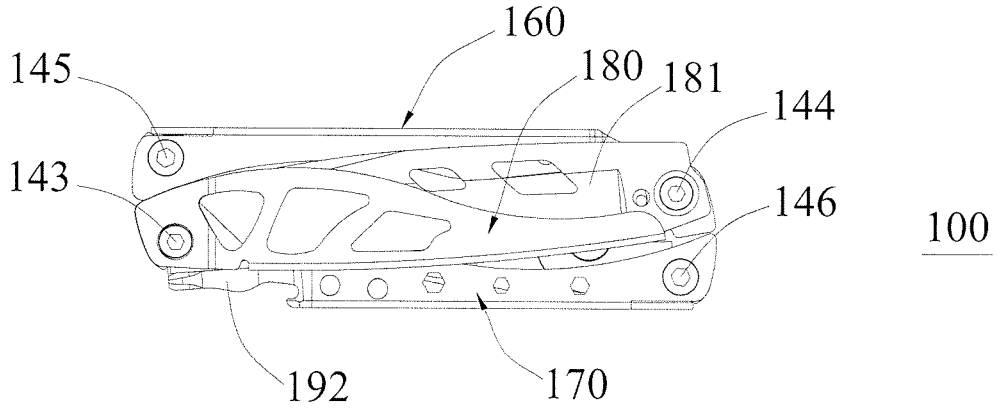
FIG. 14 is a front view of FIG. 1.
Figure 15:
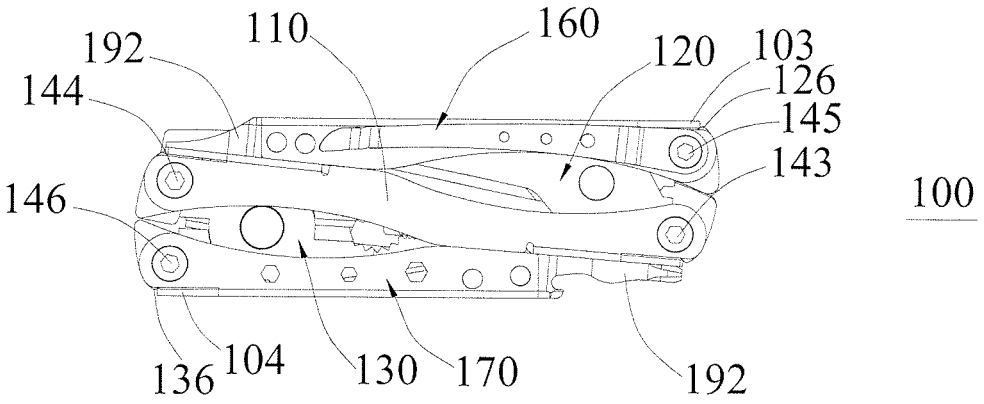
FIG. 15 is a rear view of FIG. 1.
Figure 17:
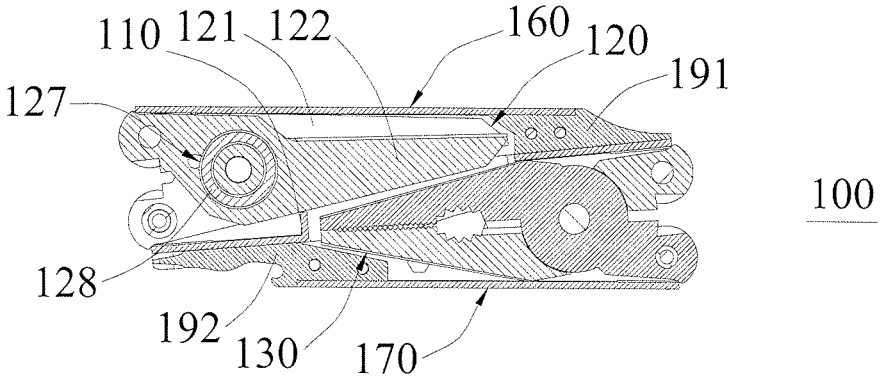
FIG. 17 is an A-A sectional view of FIG. 16.

As illustrated in FIG. 1, the scissors 120, the pliers 130, and the blade 181 all have a folded state; and as illustrated in FIG. 2, FIG. 3, FIG. 4, and FIG. 5, the scissors 120, the pliers 130, and the blade 181 all have an unfolded state. Through comparison with FIG. 2, FIG. 3, and FIG. 5, a folding or unfolding direction of the scissors 120 is reverse to that of the pliers 130. When the scissors 120 are coming to the folded state from the unfolded state, i.e., from the state as illustrated in FIG. 2 to the state as illustrated in FIG. 1, the scissors 120 rotate around the third axle 143 towards the primary housing 110 and the scissors handle 160 rotates around the fifth axle 145 towards the primary housing 110, such that the scissors 120 are folded in a space formed by the first U-shaped groove 151 and the third U-shaped groove 153. When the pliers 130 are coming to the folded state from the unfolded state, i.e., from the state as illustrated in FIG. 3 to the state as illustrated in FIG. 1, the pliers 130 rotate around the fourth axle 144 towards the primary housing 110 and the pliers handle 170 rotates around the sixth axle 146 towards the primary housing 110, such that the pliers 130 are folded in a space formed by the second U-shaped groove 152 and the fourth U-shaped groove 154. When the blade 181 is coming to the folded state from the unfolded state, i.e., from the state as illustrated in FIG. 4 to the state as illustrated in FIG. 1, the blade 181 rotates around the fourth axle 144 towards the secondary housing 180, such that the blade 181 is folded in the fifth U-shaped groove 155, and is locked by the locking shrapnel 182 by abutting thereagainst. The folded states of the scissors 120 and the pliers 130 are as illustrated in FIG. 14, FIG. 15, and FIG. 17, and the folded state of the blade 181 is as illustrated in FIG. 14.

When the scissors 120 are coming to the unfolded state from the folded state, i.e., from the state as illustrated in FIG. 1 to the state as illustrated in FIG. 2, the scissors handle 160 rotates around the fifth axle 145 far away from the primary housing 110 and the scissors 120 rotate around the third axle 143 far away from the primary housing 110, such that the scissors handle 160 and the primary housing 110 form an operation handle of the scissors 120. When the pliers 130 are coming to the unfolded state from the folded state, i.e., from the state as illustrated in FIG. 1 to the state as illustrated in FIG. 3, the pliers handle 170 rotates around the sixth axle 146 far away from the primary housing 110 and the pliers 130 rotate around the fourth axle 144 far away from the primary housing 110, such that the pliers handle 170 and the primary housing 110 form an operation handle of the pliers 130.

In this embodiment, a rear end of the scissors handle 160 is connected to a slotted screwdriver 191, and a rear end of the pliers handle 170 is connected to a cross screwdriver 192, as illustrated in FIG. 2, FIG. 3, FIG. 5, and FIG. 7. The slotted screwdriver 191 is mounted in the third U-shaped groove 153, a tool head is protrusively formed at a front end of the slotted screwdriver 191, and an end face mating with the scissors 120 in the folded state is formed at a rear end of the slotted screwdriver 191, as illustrated in FIG. 17. The cross screwdriver 192 is mounted in the fourth U-shaped groove 154, a tool head is protrusively formed at a front end of the cross screwdriver 192, and an end face mating with the pliers 130 in the folded state is formed at a rear end of the cross screwdriver 192, as illustrated in FIG. 17. As illustrated in FIG. 17, in the folded state, the rear end of the slotted screwdriver 191 abuts against the front end of the scissors 120, and the rear end of the cross screwdriver 192 abuts against the front end of the pliers 130. Under collaboration of the scissors handle 160 and the pliers handle 170, a side face opening of the primary housing 110 may be closed, thereby protecting the scissors 120 and the pliers 130, and preventing the scissors 120 and the pliers 130 from sliding out.

With reference to FIG. 6, FIG. 8, FIG. 9, and FIG. 10, on the primary housing 110, a first cantilever shrapnel 101 is formed on a side bottom plate of the first U-shaped groove 151 facing towards the scissors 120, and on the scissors handle 160, a third cantilever shrapnel 103 is formed on a side bottom plate of the third U-shaped groove 153 facing towards the scissors 120. Rear ends of the first scissors blade 121 and the second scissors blade 122 of the scissors 120 have arc-shaped faces, wherein: a first step 123 and a third step 124 that mate with the first cantilever shrapnel 101 and the third cantilever shrapnel 103 in the unfolded state are formed on inner sides of the rear ends, as illustrated in FIG. 2; and a first protrusion 125 and a third protrusion 126 that mate with the first cantilever shrapnel 101 and the third cantilever shrapnel 103 in the folded state are formed on outer sides of the rear ends, as illustrated in FIG. 1 and FIG. 15.

Figure 6:
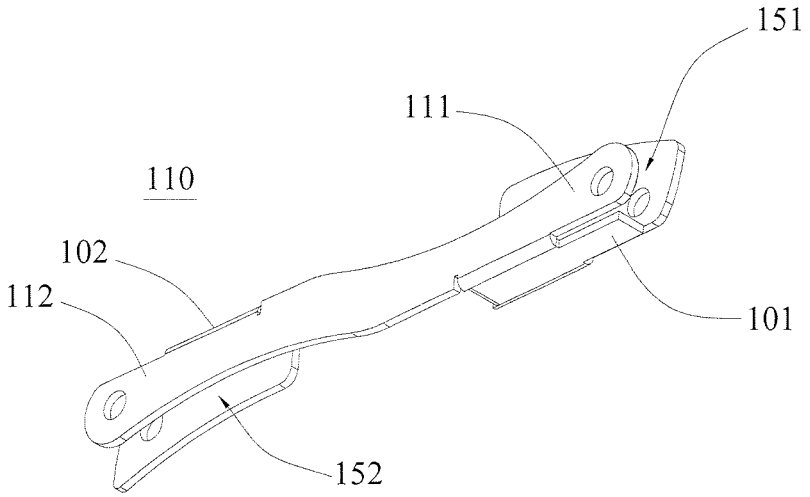
FIG. 6 is a schematic structural view of a primary housing according to Embodiment 1 of the present invention.
Figure 7:
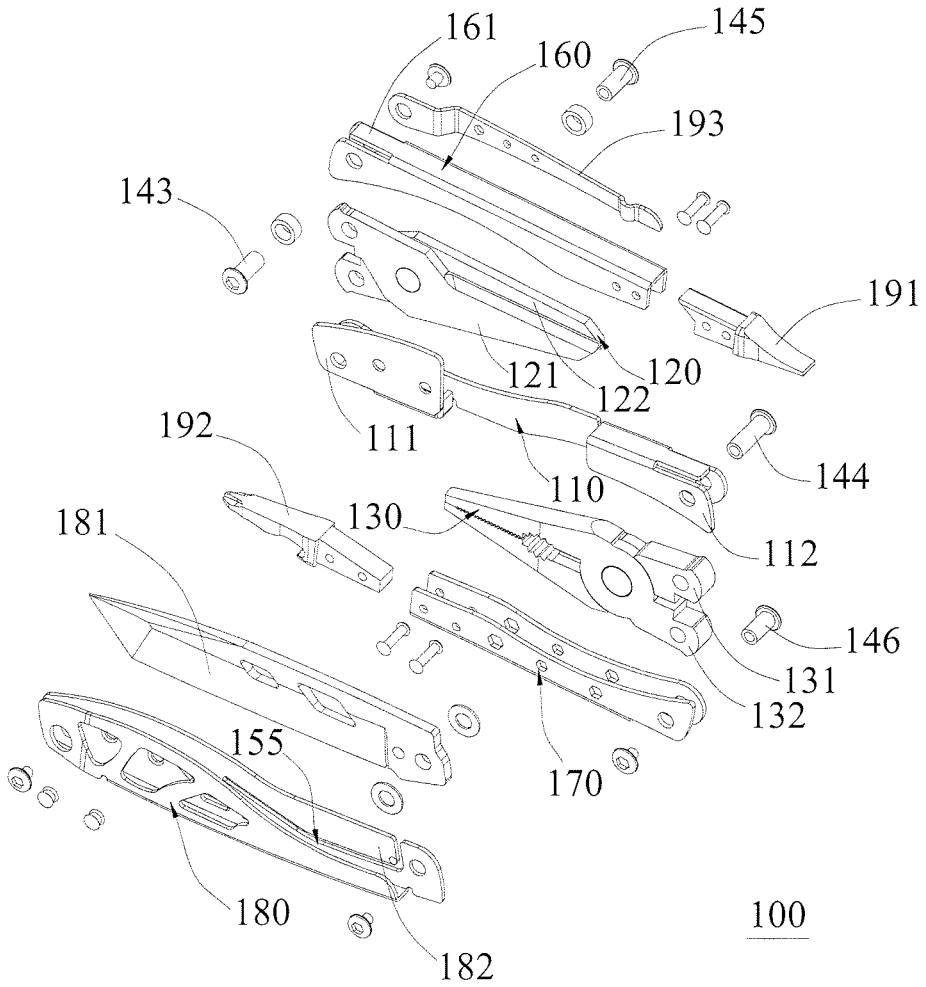
FIG. 7 is an exploded structural view according to Embodiment 1 of the present invention.
Figure 8:
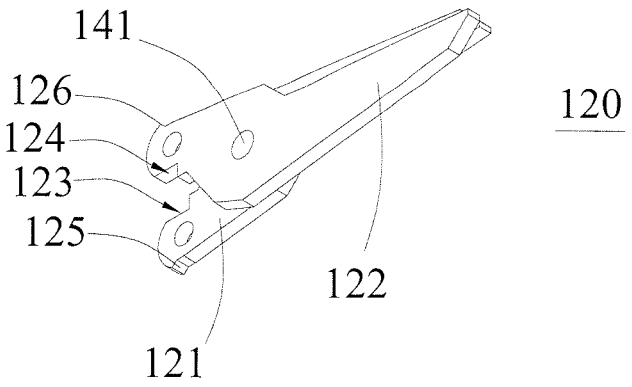
FIG. 8 is a schematic structural view of scissors according to Embodiment 1 of the present invention.
Figure 9:
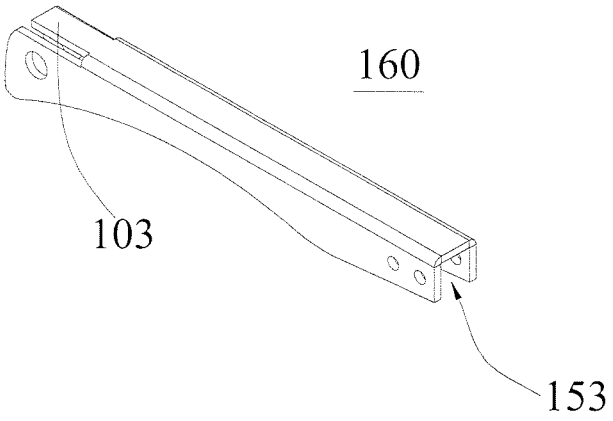
FIG. 9 is a schematic structural view of a scissors handle according to Embodiment 1 of the present invention.
Figure 10:
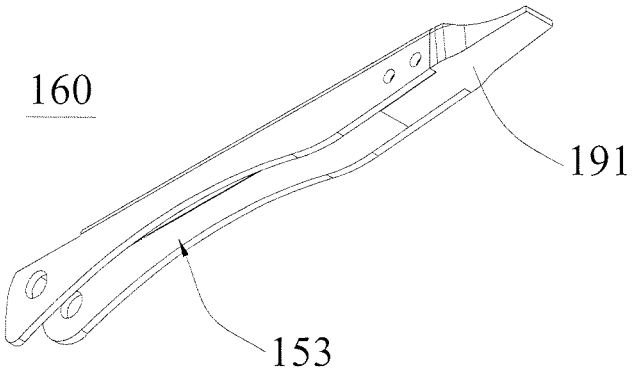
FIG. 10 is another schematic structural view of the scissors handle according to Embodiment 1 of the present invention.
Figure 11:
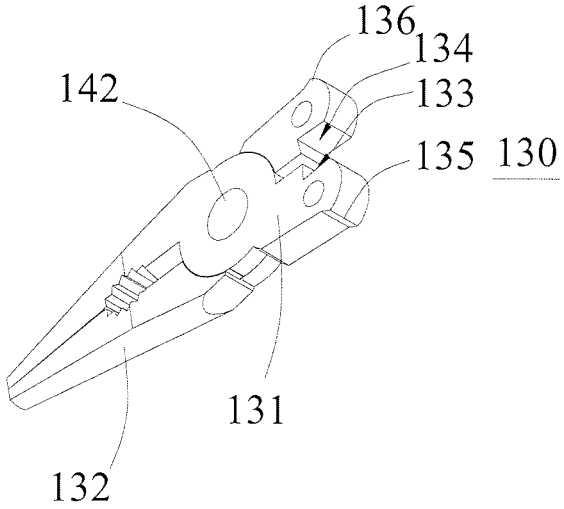
FIG. 11 is a schematic structural view of pliers according to Embodiment 1 of the present invention.
Figure 12:
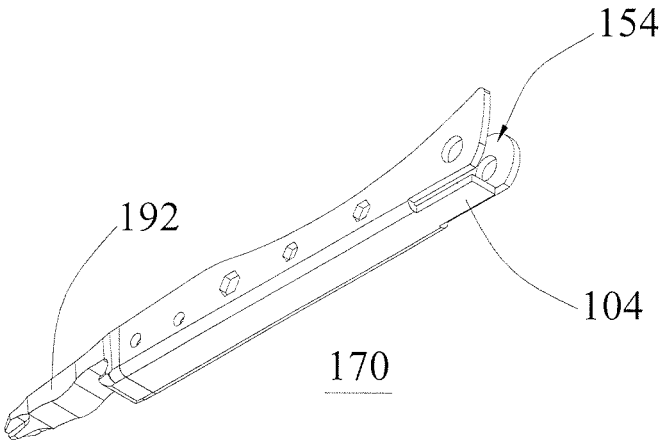
FIG. 12 is a schematic structural view of a pliers handle according to Embodiment 1 of the present invention.

With reference to FIG. 6, FIG. 11, and FIG. 12, on the primary housing 110, a second cantilever shrapnel 102 is formed on a side bottom plate of the second U-shaped groove 152 facing towards the pliers 130, and on the pliers handle 170, a fourth cantilever shrapnel 104 is formed on a side bottom plate of the fourth U-shaped groove 154 facing towards the pliers 130. Rear ends of the first gripping jaw 131 and the second gripping jaw 132 have arc-shaped faces, wherein: a second step 133 and a fourth step 134 that mate with the second cantilever shrapnel 102 and the fourth cantilever shrapnel 104 in the unfolded state are formed on inner sides of the rear ends, as illustrated in FIG. 3; and a second protrusion 135 and a fourth protrusion 136 that mate with the second cantilever shrapnel 102 and the fourth cantilever shrapnel 104 in the folded state are formed on outer sides of the rear ends, as illustrated in FIG. 15.

Figure 16:
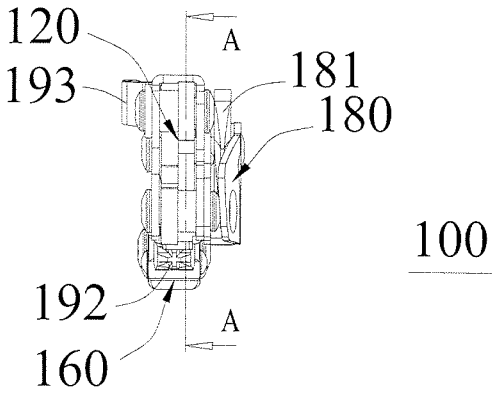
FIG. 16 is a side view of FIG. 1.

With the above structure, in the folded state, the entire scissors and pliers combination tool 100 has a small thickness, as illustrated in FIG. 16, which is convenient for accommodation. Even in the unfolded state, the tool is not very thick, still facilitating operations of the tool. For ease of operation of the scissors 120, an annular groove 127 is disposed between two opposite faces of the first scissors blade 121 and the second scissors blade 122, wherein an annular spring 128 is mounted in the annular groove 127, the annular spring 128 having a preset resilience to support the first scissors blade 121 and the second scissors blade 122 in an open state when the scissors 120 are in an unfolded state.

Embodiment 2

Figure 18:
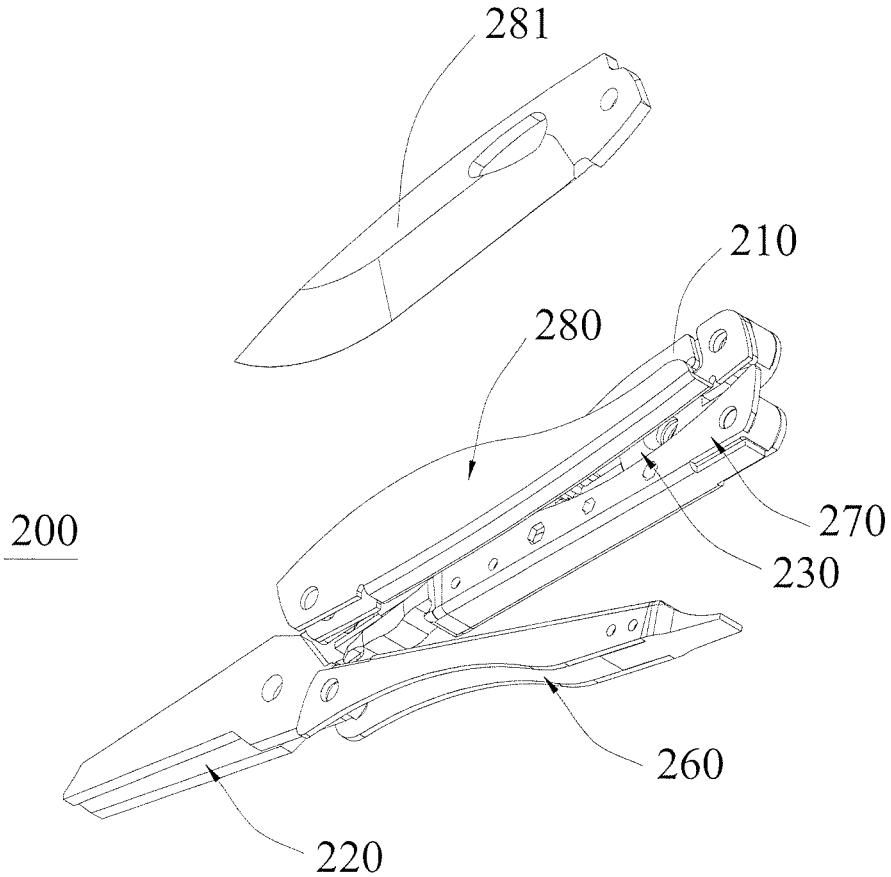
FIG. 18 is a schematic structural view of scissors in an unfolded state according to Embodiment 2 of the present invention.
Figure 19:
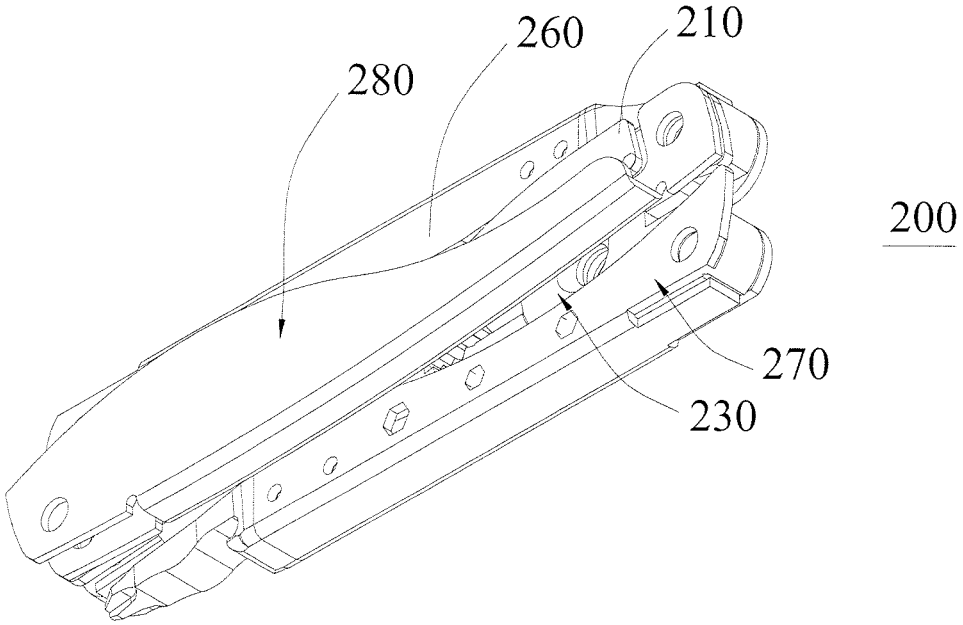
FIG. 19 is a schematic structural view of a folded state according to Embodiment 2 of the present invention.
Figure 20:
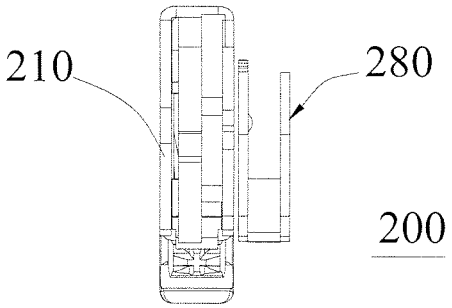
FIG. 20 is a side view of FIG. 19.

If the thickness of the combination tool needs to be further reduced based on Embodiment 1, blades having a smaller thickness may be employed, and the belt clamp may not be used. FIG. 18 illustrates a scissors and pliers combination tool 200 in an unfolded state. In this state, pliers 230 are folded between a primary housing 210 and a pliers handle 270, and scissors 220 and a scissors handle 260 are in an unfolded state. A secondary housing 280 is disposed on a side face of the primary housing 210. A blade 281 having a smaller thickness than that of the blade 181 is disposed in the secondary housing 281. For ease of observation, in FIG. 18, the blade 280 is separately illustrated. Since the blade 280 has a smaller thickness, the thickness of the secondary housing 280 may also be greatly reduced. FIG. 19 illustrates the above structure in a folded state. As seen from FIG. 20, the entire combination tool formed of the primary housing 210 and the secondary housing 280 according to this embodiment has a smaller thickness than that of the combination tool according to Embodiment 1.

Embodiment 3

Figure 21:
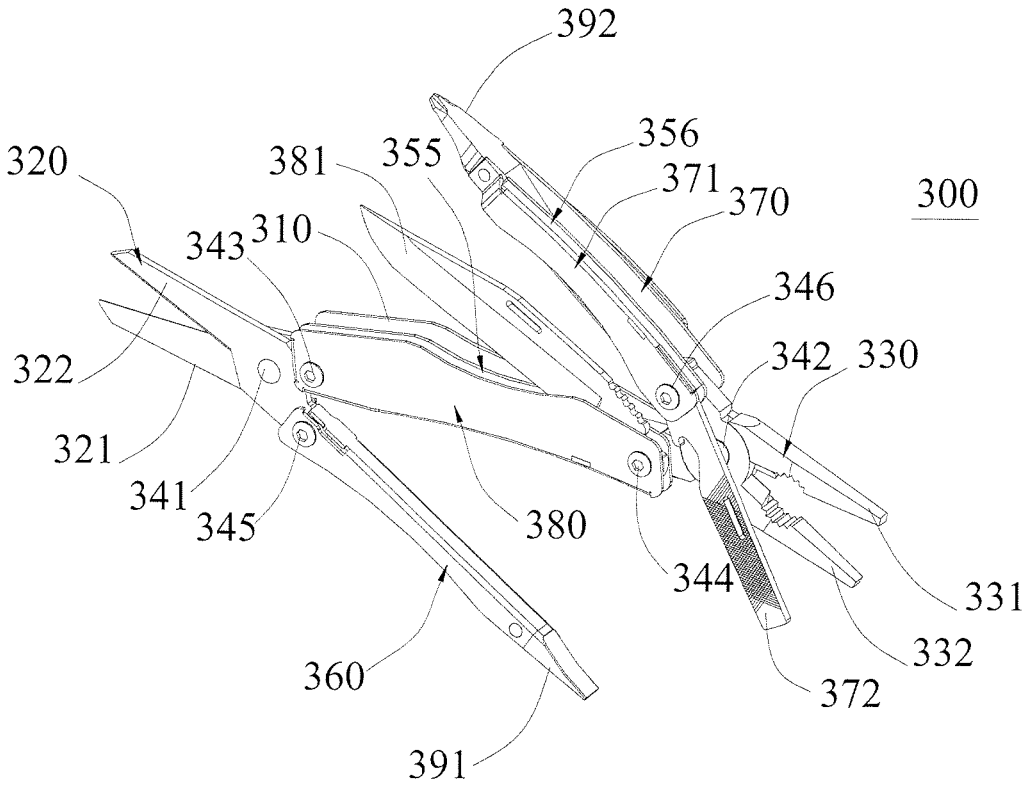
FIG. 21 is a schematic structural view of all the tools in an unfolded state according to Embodiment 3 of the present invention.
Figure 30:
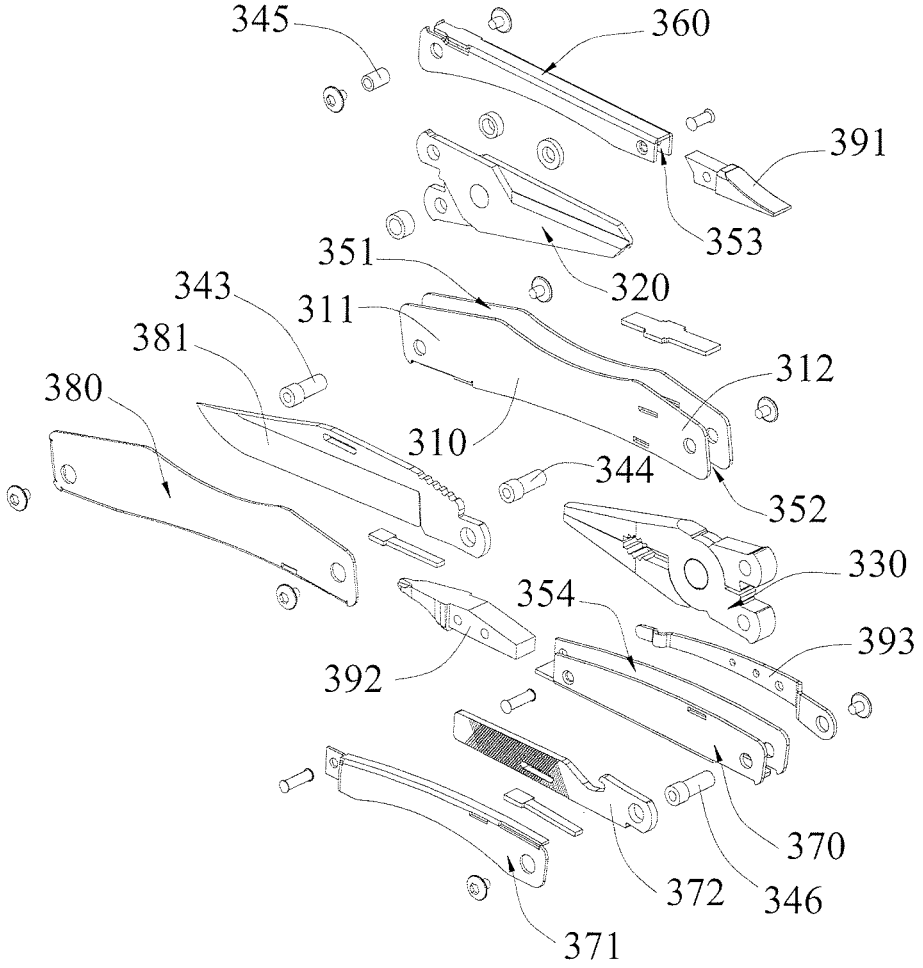
FIG. 30 is an exploded structural view according to Embodiment 3 of the present invention.

This embodiment is an improvement made based on Embodiment 1, with reference to FIG. 21 and FIG. 30, a scissors and pliers combination tool 300 comprises: scissors 320 having a front end and a rear end, and comprising a first scissors blade 321 and a second scissors blade 322 that are hinged through a first axle 341 at a central portion; pliers 330 having a front end and a rear end, and comprising a first gripping jaw 331 and a second gripping jaw 332 that are hinged through a second axle 342 at a central portion; a primary housing 310 having a first end portion 311 and a second end portion 312, a first U-shaped groove 351 being formed at the first end portion 311 and a second U-shaped groove 352 being formed at the second portion 312, wherein an opening direction of the first U-shaped groove 351 is reverse to that of the second U-shaped groove 352, the rear end of the first scissors blade 321 is hinged through a third axle 343 to the first end portion 311, and the rear end of the first gripping jaw 331 is hinged through a fourth axle 344 to the second end portion 312; a scissors handle 360, a front end of the scissors handle 360 being hinged to the rear end of the second scissors blade 322 through a fifth axle 345, and a third U-shaped groove 353 being disposed on a side facing towards the scissors 320; and a pliers handle 370, a front end of the pliers handle 370 being hinged to the rear end of the second gripping jaw 332 through a sixth axle 346, and a fourth U-shaped groove 354 being disposed on a side facing towards the gripping jaw 330. The scissors and pliers combination tool 300 further comprises a secondary housing 380, wherein the secondary housing 180 is disposed on a side face of the primary housing 310, and is connected to the side face of the primary housing 310 via the third axle 343 and the fourth axle 344. The secondary housing 380 forms a fifth U-shaped groove 355, wherein a blade 381 is foldably mounted in the fifth U-shaped groove 355, the blade 381 being rotatably connected via the fourth axle 344. The scissors and pliers combination tool 300 further comprises a secondary handle 371, wherein the secondary handle 371 is disposed on a side of the pliers handle 370 facing towards the secondary housing 380, having a thickness the same as that of the secondary housing 380, wherein the secondary handle 371 abuts against, together with the pliers handle 370, a side back to an opening of the fifth U-shaped groove 355 of the secondary housing 380 after being folded, and the secondary handle 371 forms a sixth U-shaped groove 356, an opening direction of the sixth U-shaped groove being reverse to an opening direction of the fifth U-shaped groove 355, and a file 372 being internally foldably mounted in the sixth U-shaped groove 356, the file 372 being rotatably connected to the sixth axle 346. A belt clamp 393 is further disposed on the other side of the pliers handle 370 relative to the secondary handle 371.

Figure 22:
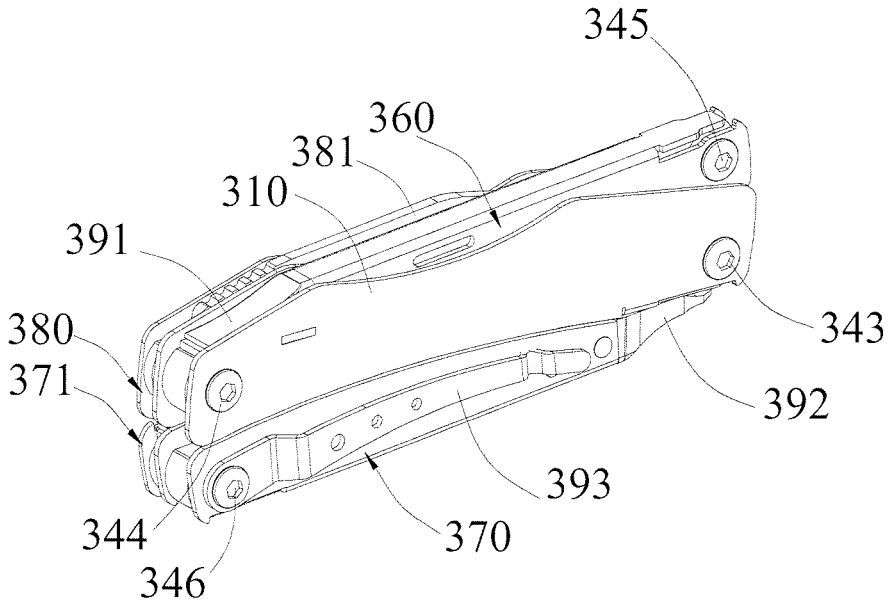
FIG. 22 is a schematic structural view of a folded state according to Embodiment 3 of the present invention.
Figure 23:
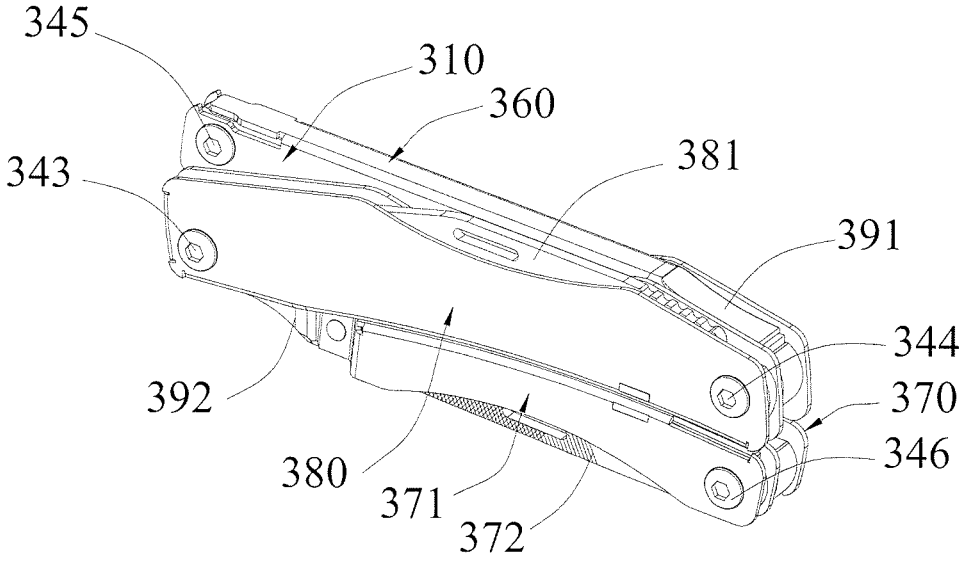
FIG. 23 is another schematic structural view of the folded state according to Embodiment 3 of the present invention.
Figure 28:
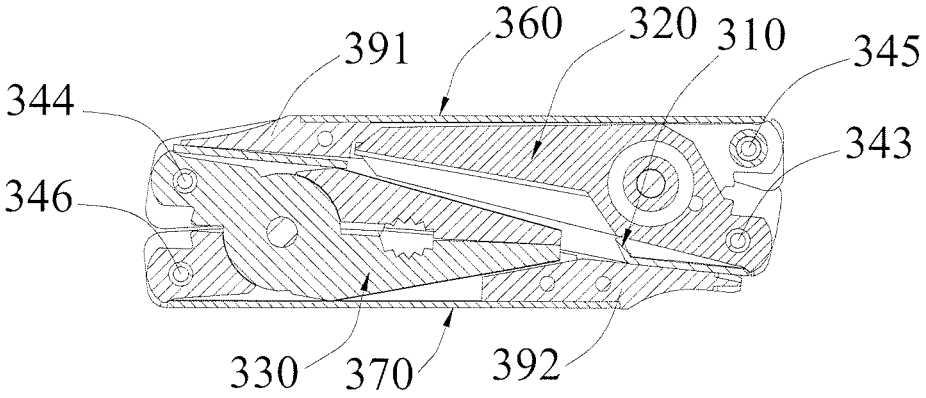
FIG. 28 is a B-B sectional view of FIG. 27.

In this embodiment, a rear end of the scissors handle 360 is connected to a slotted screwdriver 391, and a rear end of the pliers handle 370 is connected to a cross screwdriver 392, as illustrated in FIG. 21. The slotted screwdriver 391 is mounted in the third U-shaped groove 353, a tool head is protrusively formed at a front end of the slotted screwdriver 391, and an end face mating with the scissors 320 in the folded state is formed at a rear end of the slotted screwdriver 391. The cross screwdriver 392 is mounted in the fourth U-shaped groove 354, a tool head is protrusively formed at a front end of the cross screwdriver 392, and an end face mating with the pliers 330 in the folded state is formed at a rear end of the cross screwdriver 392. As illustrated in FIG. 22, FIG. 23, and FIG. 28, in the folded state, the rear end of the slotted screwdriver 391 abuts against the front end of the scissors 320, and the rear end of the cross screwdriver 392 abuts against the front end of the pliers 330. Under collaboration of the scissors handle 360 and the pliers handle 370, a side face opening of the primary housing 310 may be closed, thereby protecting the scissors 320 and the pliers 330, and preventing the scissors 320 and the pliers 330 from sliding out.

Figure 25:
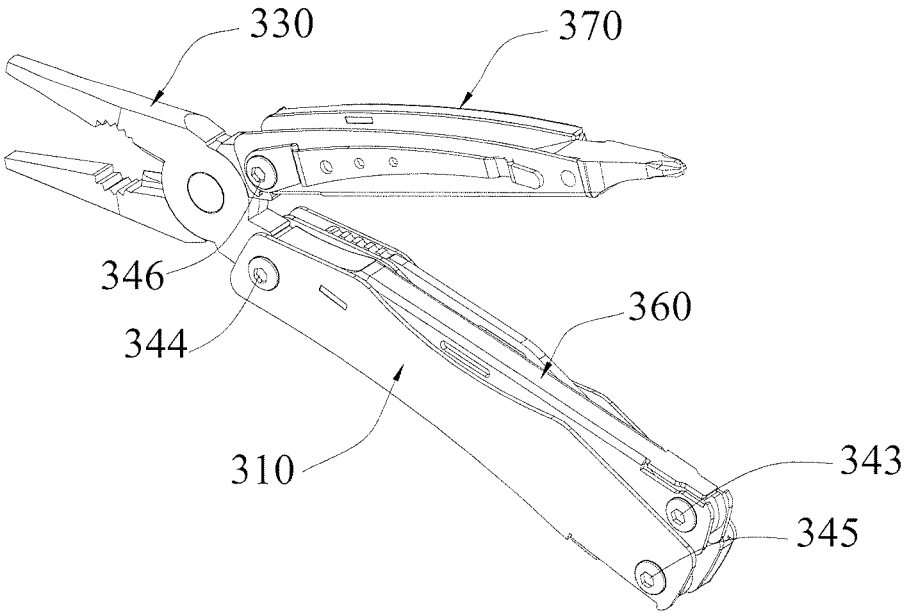
FIG. 25 is a schematic structural view of pliers in an unfolded state according to Embodiment 3 of the present invention.
Figure 26:
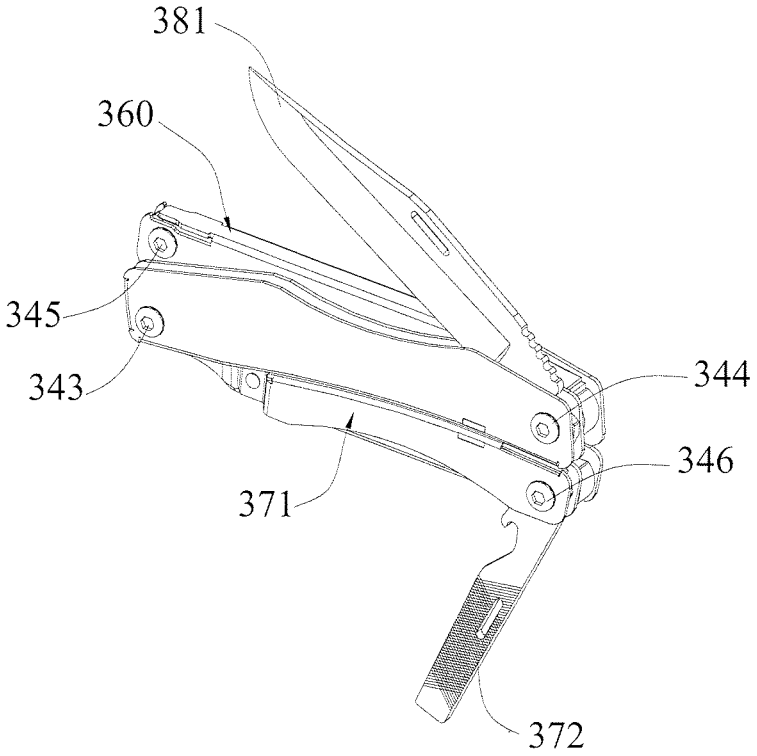
FIG. 26 is a schematic view of a knife in an unfolded state according to Embodiment 3 of the present invention.
Figure 27:
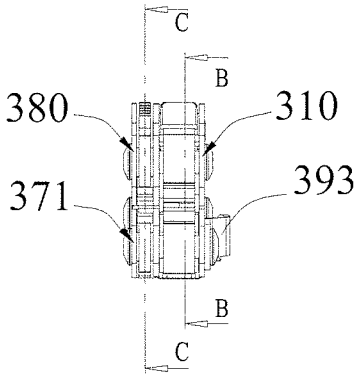
FIG. 27 is a side view of a folded state according to Embodiment 3 of the present invention.
Figure 29:
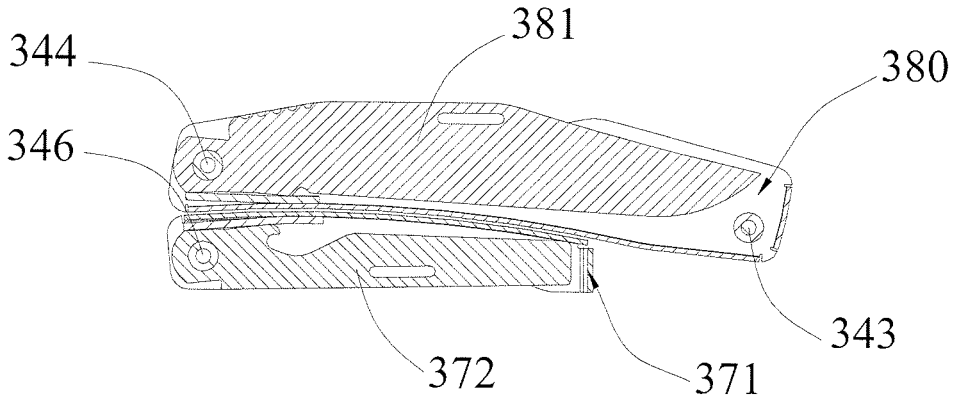
FIG. 29 is a C-C sectional view of FIG. 27.

As illustrated in FIG. 22 and FIG. 23, the scissors 320, the pliers 330, the blade 381, and the file 372 all have a folded state; and as illustrated in FIG. 21, FIG. 24, FIG. 25, and FIG. 26, the scissors 320, the pliers 330, the blade 381, and the file 372 all have an unfolded state. Through comparison with FIG. 21, FIG. 24, and FIG. 25, a folding or unfolding direction of the scissors 320 is reverse to that of the pliers 330. When the scissors 320 are coming to the folded state from the unfolded state, i.e., from the state as illustrated in FIG. 21 to the state as illustrated in FIG. 22 and FIG. 23, the scissors 320 rotate around the third axle 343 towards the primary housing 310 and the scissors handle 360 rotates around the fifth axle 345 towards the primary housing 310, such that the scissors 320 are folded in a space formed by the first U-shaped groove 351 and the third U-shaped groove 353. The pliers 330 rotate around the fourth axle 344 towards the primary housing 310 and the pliers handle 370 rotates around the sixth axle 346 towards the primary housing 310, such that the pliers 330 are folded in a space formed by the second U-shaped groove 352 and the fourth U-shaped groove 354. The blade 381 rotates around the fourth axle 344 towards the secondary housing 380 such that the blade 381 is folded in the fifth U-shaped groove 355, and the file 372 rotates around the sixth axle 346 towards the secondary handle 371 such that the file 372 is folded in the sixth U-shaped groove 356. With the above structure, in the folded state, a side view of the tool is as illustrated in FIG. 27, and an internal structural view of the tool is as illustrated in FIG. 28 and FIG. 29. As seen from the structure in the folded state, the volume of the tool is reduced and the thickness of the tool is small, and thus it is convenient to carry and accommodate the tool.

Figure 24:
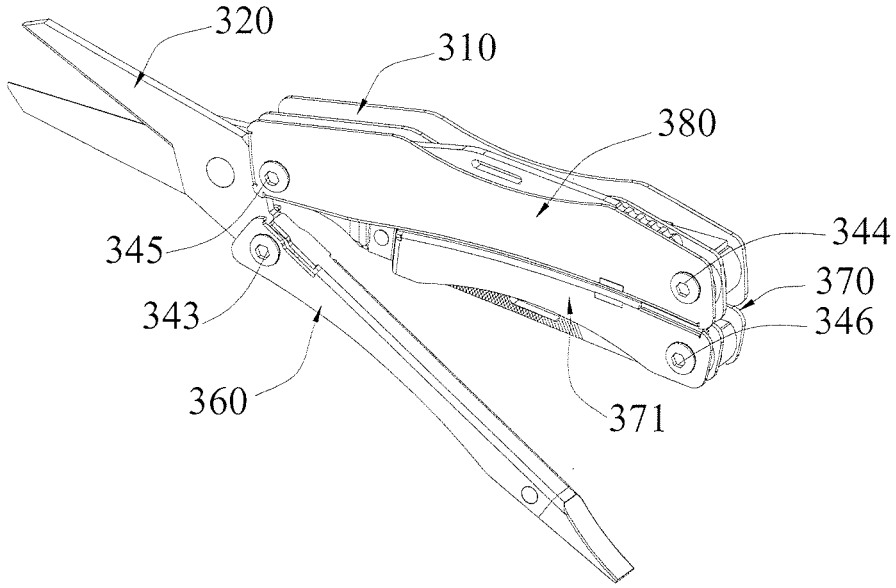
FIG. 24 is a schematic view of scissors in an unfolded state according to Embodiment 3 of the present invention.

When the scissors 320 are coming to the unfolded state from the folded state, i.e., from the state as illustrated in FIG. 22 and FIG. 23 to the state as illustrated in FIG. 24, the scissors handle 360 rotates around the fifth axle 345 far away from the primary housing 310 and the scissors 320 rotate around the third axle 343 far away from the primary housing 310, such that the scissors handle 360 and the primary housing 310 form an operation handle of the scissors 320. When the pliers 330 are coming to the unfolded state from the folded state, i.e., from the state as illustrated in FIG. 22 and FIG. 23 to the state as illustrated in FIG. 25, the pliers handle 370 rotates around the sixth axle 346 far away from the primary housing 310 and the pliers 330 rotate around the fourth axle 344 far away from the primary housing 310, such that the pliers handle 370 and the primary housing 310 form an operation handle of the pliers 330. Further, as illustrated in FIG. 26, the blade 381 rotates around the fourth axle 344 far away from the secondary housing 380 such that the blade 381 rotates out of the fifth U-shaped groove 355, and the file 372 rotates around the sixth axle 346 far away from the secondary handle 371 such that the file 372 rotates out of the sixth U-shaped groove 356.

The terms for denoting the position relationships in the drawings are merely for exemplary illustration, but shall not be construed as limitations to the present invention. Obviously, the above embodiments are merely exemplary ones for illustrating the present invention, but are not intended to limit the implementation of the present invention. Persons of ordinary skills in the art may derive other modifications and variations based on the above embodiments. All embodiments of the present invention are not exhaustively listed herein. Any modification, equivalent replacement, or improvement made without departing from the spirit and principle of the present invention should fall within the protection scope of the present invention.

What is claimed is:

1. A scissors and pliers combination tool, comprising:

scissors having a front end and a rear end, and comprising a first scissors blade and a second scissors blade that are hinged through a first axle at a central portion;

pliers having a front end and a rear end, and comprising a first gripping jaw and a second gripping jaw that are hinged through a second axle at a central portion;

a primary housing having a first end portion and a second end portion, a first U-shaped groove being formed at the first end portion and a second U-shaped groove being formed at the second end portion, the first end portion and the second end portion forming a slot, wherein an opening direction of the first U-shaped groove is reverse to that of the second U-shaped groove, a rear end of the first scissors blade is hinged through a third axle to the first end portion, and a rear end of the first gripping jaw is hinged through a fourth axle to the second end portion;

wherein a first cantilever shrapnel is formed on a side bottom plate of the first U-shaped groove facing towards the scissors and connected between side walls, a second cantilever shrapnel is formed on a side bottom plate of the second U-shaped groove facing towards the pliers and connected between said sidewalls, said first cantilever shrapnel and said second cantilever shrapnel not being directly connected;

a scissors handle, a front end of the scissors handle being hinged to a rear end of the second scissors blade through a fifth axle, and a third U-shaped groove being disposed on a side facing towards the scissors;

a pliers handle, a front end of the pliers handle being hinged to a rear end of the second gripping jaw through a sixth axle, and a fourth U-shaped groove being disposed on a side facing towards the gripping jaw;

wherein the scissors and pliers have a folded state and unfolded state on the primary housing, and a folding or unfolding direction of the scissors is reverse to that of the pliers;

from the unfolded state to the folded state, the scissors rotate around the third axle towards the primary housing and the scissors handle rotates around the fifth axle towards the primary housing, such that the scissors are folded in a space formed by the first U-shaped groove and the third U-shaped groove; pliers rotate around the fourth axle towards the primary housing and pliers handle rotates around the sixth axle towards the primary housing, such that the pliers are folded in a space formed by the second U-shaped groove and the fourth U-shaped groove; and from the folded state to the unfolded state, the scissors handle rotates around the fifth axle far away from the primary housing and the scissors rotate around the third axle far away from the primary housing, such that the scissors handle and the primary housing form an operation handle of the scissors; or the pliers handle rotates around the sixth axle far away from the primary housing and the pliers rotate around the fourth axle far away from the primary housing, such that the pliers handle and the primary housing form an operation handle of the pliers;

in the folded state, the front ends of both the scissors and the pliers being received in the slot.

2. The scissors and pliers combination tool according to claim 1, wherein a third cantilever shrapnel is formed on a side bottom plate of the third U-shaped groove facing towards the scissors, and rear ends of the first scissors blade and the second scissors blade have arc-shaped faces, a first step and a third step that mate with the first cantilever shrapnel and the third cantilever shrapnel in the unfolded state being formed on inner sides of the rear ends, and a first protrusion and a third protrusion that mate with the first cantilever shrapnel and the third cantilever shrapnel in the folded state being formed on and extending beyond outer sides of the rear ends.

3. The scissors and pliers combination tool according to claim 2 wherein the rear end of the scissors handle or the rear end of the pliers handle is provided with a rotating tool, or the rear end of the scissors handle and the rear end of the pliers handle are each provided with a rotating tool.

4. The scissors and pliers combination tool according to claim 3, wherein each rotating tool comprises one of a slotted screwdriver, a cross screwdriver, a drill, or a corkscrew.

5. The scissors and pliers combination tool according to claim 3, wherein the rotating tool is mounted in the third U-shaped groove, or the fourth U-shaped groove, or in the third U-shaped groove and the fourth U-shaped groove, a tool head is protrusively formed at a front end of the rotating tool, and an end face mating with the scissors or the tool head in the folded state is formed at a rear end of the rotating tool.

6. The scissors and pliers combination tool according to claim 2, wherein an annular groove is disposed between two opposite faces of the first scissors blade and the second scissors blade, an annular spring being mounted in the annular groove, the annular spring having a preset resilience to support the first scissors blade and the second scissors blade in an open state when the scissors are in an unfolded state.

7. The scissors and pliers combination tool according to claim 2, further comprising a secondary housing disposed on a side face of the primary housing, wherein the secondary housing forms a fifth U-shaped groove, a blade being foldably mounted in the fifth U-shaped groove.

8. The scissors and pliers combination tool according to claim 7, wherein an inner side face of the secondary housing is provided with a locking shrapnel, the locking shrapnel abutting against a side face of the blade when the blade is folded into the fifth U-shaped groove.

9. The scissors and pliers combination tool according to claim 7, further comprising a secondary handle disposed on a side of the pliers handle or the scissors handle facing towards the secondary housing, and having a thickness the same as that of the secondary housing, wherein the secondary handle abuts against an opposite side of an opening of the fifth U-shaped groove of the secondary housing after being folded, and the secondary handle forms a sixth U-shaped groove, an opening direction of the sixth U-shaped groove being reverse to an opening direction of the fifth U-shaped groove, and a secondary tool head being internally foldably mounted in the sixth U-shaped groove.

10. The scissors and pliers combination tool according to claim 1, wherein a fourth cantilever shrapnel is formed on a side bottom plate of the fourth U-shaped groove facing towards the pliers, and rear ends of the first gripping jaw and the second gripping jaw have arc-shaped faces, a second step and a fourth step that mate with the second cantilever shrapnel and the fourth cantilever shrapnel in the unfolded state being formed on inner sides of the rear ends, and a second protrusion and a fourth protrusion that mate with the second cantilever shrapnel and the fourth cantilever shrapnel in the folded state being formed on and extending beyond outer sides of the rear ends.

11. The scissors and pliers combination tool according to claim 10 wherein the rear end of the scissors handle or the rear end of the pliers handle is provided with a rotating tool, or the rear end of the scissors handle and the rear end of the pliers handle are each provided with a rotating tool.

12. The scissors and pliers combination tool according to claim 11, wherein each rotating tool comprises one of a slotted screwdriver, a cross screwdriver, a drill, or a corkscrew.

13. The scissors and pliers combination tool according to claim 11, wherein the rotating tool is mounted in the third U-shaped groove, or the fourth U-shaped groove, or in the third U-shaped groove and the fourth U-shaped groove, a tool head is protrusively formed at a front end of the rotating tool, and an end face mating with the scissors or the tool head in the folded state is formed at a rear end of the rotating tool.

14. The scissors and pliers combination tool according to claim 10, wherein an annular groove is disposed between two opposite faces of the first scissors blade and the second scissors blade, an annular spring being mounted in the annular groove, the annular spring having a preset resilience to support the first scissors blade and the second scissors blade in an open state when the scissors are in an unfolded state.

15. The scissors and pliers combination tool according to claim 10, further comprising a secondary housing disposed on a side face of the primary housing, wherein the secondary housing forms a fifth U-shaped groove, a blade being foldably mounted in the fifth U-shaped groove.

16. The scissors and pliers combination tool according to claim 15, wherein an inner side face of the secondary housing is provided with a locking shrapnel, the locking shrapnel abutting against a side face of the blade when the blade is folded into the fifth U-shaped groove.

17. The scissors and pliers combination tool according to claim 15, further comprising a secondary handle disposed on a side of the pliers handle or the scissors handle facing towards the secondary housing, and having a thickness the same as that of the secondary housing, wherein the secondary handle abuts against an opposite side of an opening of the fifth U-shaped groove of the secondary housing after being folded, and the secondary handle forms a sixth U-shaped groove, an opening direction of the sixth U-shaped groove being reverse to an opening direction of the fifth U-shaped groove, and a secondary tool head being internally foldably mounted in the sixth U-shaped groove.

* * * * *